US011727743B2

(12) United States Patent
Sjöström et al.

(10) Patent No.: US 11,727,743 B2
(45) Date of Patent: Aug. 15, 2023

(54) CASH DEPOSITING AND DISPENSING MACHINE AND A METHOD FOR ACCESSING A CASH DEPOSITING AND DISPENSING MACHINE

(71) Applicant: Scan Coin AB, Malmö (SE)

(72) Inventors: Anders Sjöström, Lomma (SE); Andreas Johansson, Malmö (SE)

(73) Assignee: Scan Coin AB, Malmo (SE)

( * ) Notice: Subject to any disclaimer, the term of this patent is extended or adjusted under 35 U.S.C. 154(b) by 286 days.

(21) Appl. No.: 17/262,577

(22) PCT Filed: Jul. 18, 2019

(86) PCT No.: PCT/SE2019/050701
§ 371 (c)(1),
(2) Date: Jan. 22, 2021

(87) PCT Pub. No.: WO2020/022947
PCT Pub. Date: Jan. 30, 2020

(65) Prior Publication Data

US 2021/0225113 A1 Jul. 22, 2021

(30) Foreign Application Priority Data

Jul. 23, 2018 (SE) ..... 1850932-3

(51) Int. Cl.
*G07D 11/40* (2019.01)
*G07D 11/60* (2019.01)
(Continued)

(52) U.S. Cl.
CPC ..... *G07D 11/125* (2019.01); *G07D 11/23* (2019.01); *G07D 11/26* (2019.01); *G07D 11/40* (2019.01);
(Continued)

(58) Field of Classification Search
CPC ..... G07D 11/125; G07D 11/26; G07D 11/40; G07D 11/60; G07F 19/205; G07F 19/209
See application file for complete search history.

(56) References Cited

U.S. PATENT DOCUMENTS 6,719,120 B2 * 4/2004 Kato ..... G07F 19/203 194/350
7,370,792 B1 5/2008 Graef et al.
(Continued)

FOREIGN PATENT DOCUMENTS

EP 0307526 A1 3/1989
GB 2544718 A 5/2017
(Continued)

OTHER PUBLICATIONS

International Search Report and Written Opinion dated Sep. 9, 2019 in connection with International Application No. PCT/SE2019/050701.

*Primary Examiner* — Christle I Marshall
(74) *Attorney, Agent, or Firm* — Wolf, Greenfield & Sacks, P.C.

(57) ABSTRACT

The disclosure relates to a cash depositing and dispensing machine comprising: a machine body having outer circumferential walls, and an arrangement comprising: a cash input/output unit having an interface for allowing depositing and dispensing of cash, a cash handling unit, and a cash storage unit, wherein said cash input/output unit, said cash handling unit, and said cash storage unit being arranged in relation to each other in relation to said machine body between: a closed position for which the outer circumferential walls of the machine body enclose the cash handling unit and the cash storage unit so as to prevent access thereto, and a service position and a cash access position for which
(Continued)

at least the cash handling unit protrudes from the machine body so as to allow access thereto.

13 Claims, 5 Drawing Sheets

(51) Int. Cl.

| | |
|---|---|
| ***G07F 19/00*** | (2006.01) |
| ***G07D 11/125*** | (2019.01) |
| ***G07D 11/23*** | (2019.01) |
| ***G07D 11/26*** | (2019.01) |

(52) U.S. Cl.
CPC ..... *G07D 11/60* (2019.01); *G07F 19/202* (2013.01); *G07F 19/203* (2013.01); *G07F 19/205* (2013.01); *G07F 19/209* (2013.01)

(56) References Cited

U.S. PATENT DOCUMENTS

| | | | |
|---|---|---|---|
| 2004/0222284 | A1 | 11/2004 | Yamamoto et al. |
| 2009/0057423 | A1 | 3/2009 | Nobuhara et al. |
| 2010/0264208 | A1 | 10/2010 | Lipkowitsch et al. |
| 2015/0100489 | A1 | 4/2015 | Graef et al. |
| 2015/0267458 | A1 | 9/2015 | Cardinal et al. |
| 2018/0053383 | A1 | 2/2018 | Whiteaker |

FOREIGN PATENT DOCUMENTS

| | | | |
|---|---|---|---|
| JP | 2002-260057 A | | 9/2002 |
| WO | WO 8500905 | * | 2/1985 |

* cited by examiner

CASH DEPOSITING AND DISPENSING MACHINE AND A METHOD FOR ACCESSING A CASH DEPOSITING AND DISPENSING MACHINE

RELATED APPLICATIONS

This application is a national stage filing under 35 U.S.C. 371 of International patent Application Serial No. PCT/SE2019/050701, filed Jul. 18, 2019, entitled A CASH DEPOSITING AND DISPENSING MACHINE AND A METHOD FOR ACCESSING A CASH DEPOSTING AND DISPENSING MACHINE. Foreign priority benefits are claimed under 35 U.S.C. § 119(a)-(d) or 35 U.S.C. § 365(b) of Swedish application number 1850932-3, filed Jul. 23, 2018. The entire contents of these applications are incorporated herein by reference in their entirety.

TECHNICAL FIELD

The present invention relates to a cash depositing and dispensing machine and a method for accessing said machine.

BACKGROUND

Cash depositing and dispensing machines are typically used for depositing cash to an account, withdrawing cash from an account or for cash transactions to/from another party during a sale. One kind of cash depositing and dispensing machine is used at point of sale (PoS), and are especially designed and constructed to be used for said cash transactions during a sale. As cash depositing and dispensing machines may store large quantities of cash, security is an important aspect. At the same time, automatic handling of cash, such as bank notes or coins, often requires the use of delicate mechanical interior parts. As such mechanical parts are subject to wear and tear, as well as time-to-time malfunctioning, it is of further importance to provide a cash depositing and dispensing machine allowing relatively easy means for service access to the interior parts to minimize the total down time of the machine. Furthermore, space limitations at the location of the cash depositing and dispensing machines, as well as ergonomic considerations for the service personnel are of importance. As current cash depositing and dispensing machines suffer from at least some of aforementioned deficiencies, there is a need for an improved cash depositing and dispensing machine.

SUMMARY

It is an object to mitigate, alleviate or eliminate one or more of the above-identified deficiencies in the art and disadvantages singly or in any combination.

These and other objects of the invention are at least partly met by the invention as defined in the independent claims. Preferred embodiments are set out in the dependent claims.

According to a first aspect there is provided a cash depositing and dispensing machine comprising:

a machine body having outer circumferential walls, and an arrangement comprising:

a cash input/output unit having an interface for allowing depositing and dispensing of cash, a cash handling unit, and a cash storage unit, wherein said cash input/output unit, said cash handling unit, and said cash storage unit being arranged in relation to each other along a displacement direction, and wherein the arrangement is displaceable in relation to said machine body along the displacement direction between:

a closed position for which the outer circumferential walls of the machine body enclose the cash handling unit and the cash storage unit so as to prevent access thereto, a service position for which the cash handling unit but not the cash storage unit protrudes from the machine body so as to allow access to the cash handling unit and prevent access to the cash storage unit, and a cash access position for which both the cash handling unit and the cash storage unit protrude from the machine body so as to allow access to the cash handling unit and the cash storage unit.

The cash depositing and dispensing machine of the disclosure thus provides a way to meet the above specified requirements for the machine by allowing displacing, or shifting, the arrangement comprising interior parts of the machine upwards. Access to the interior parts depend on the level to which the arrangement is shifted. At a first level, only parts of the interior parts may be accessed. At a second level, several parts, or all parts, of the machine may be accessed.

The cash depositing and dispensing machine may provide a solution to most, or all, of the above specified requirements by means of the one single concept of displacing machine interior parts, i.e. the arrangement, relative to the machine housing. The solution may be realized by a relatively simple mechanical solution. As the complexity of the cash depositing and dispensing machine thus may be lowered, the machine may be manufactured at lower costs. Furthermore, the lower complexity may decrease the risk of malfunction and reducing overall down time of the machine.

Security requirements for the cash stored within the machine, and easy service access to operating parts of the machine may be met by allowing the arrangement to be displaced to different positions. At the service position, the cash handling unit may be accessed for servicing the mechanical parts. In case the cash comprises banknotes, the access position may also allow for clearing paper jams. While being in the service position, no access is provided to the cash stored within the cash storage unit. Thus, security is not compromised. The service position is typically accessed by service personnel and/or personnel at the store or shop in which the machine is located.

At the cash access position, the cash storage unit will also be accessible. This position is typically used when emptying or filling the cash storage unit with cash, a task typically performed by cash in transit (CIT) personnel authorized to access the cash. As readily realized by the skilled person, both the cash handling unit and the cash storage unit may be accessed when the arrangement is in the cash access position. Thus, it is understood that full service of the machine, including service to the cash storage unit may require the arrangement to be displaced to the cash access position.

Furthermore, the cash depositing and dispensing machine may be advantageous as the displacement of the arrangement comprising the cash handling unit and the cash storage unit may provide an improved ergonomy for a user, such as e.g. service personnel and cash in transit personnel. Access to the interior parts may be provided from many angles, and improves access when compared to a solution where the interior parts are not displaceable and thus accessible only when within the machine body, for example via one or more access doors.

The cash input/output unit may be configured to receive cash input by a user and transport the cash to the cash handling unit, and to receive cash from the cash handling unit and dispense the cash to the user, and the cash handling unit may further be configured to output cash to the cash storage unit.

According to some embodiments, when the arrangement is in the closed position, the outer circumferential walls of the machine body meet an outer surface of the cash input/output unit such that said outer circumferential walls and said outer surface of the cash input/output unit together define an outer seal for preventing access to the cash handling unit and the cash storage unit.

The cash input/output unit may thus effectively be defining a part of a machine exterior, although the cash input/output unit is a part of the arrangement, and not a part of the machine body. The machine body is typically configured to be stationary, whereas the cash input/output unit and the outer surface thereof is displaceable in relation to the machine housing. This may be advantageous as it allows for easy access to the cash depositing and dispensing machine without having to provide the access through the machine body, e.g. via an opening, a solution that may introduce risks for injuries and/or material jam as the arrangement including the units thereof is displaced in relation to the machine housing. Instead, cash depositing and dispensing is provided for at the end of the arrangement facing the user.

According to some embodiments, the arrangement is linearly displaceable in relation to said machine body. This may be an advantageous realization as it provides a relatively simple mechanical solution.

According to some embodiments, the arrangement is displaceable in relation to said machine body using a rail system. Such a rail system could be for example a telescopic rail system comprising one or more rail sections. Each rail section may comprise one or more rail elements configured to be slidably attached to each other.

According to some embodiments, the displacement direction is aligned substantially vertically, so as to allow the cash handling unit and the cash storage unit to be accessible in a volume above the machine. This may be advantageous as it may allow accessing the machine in an ergonomically improved way. Moreover, in many applications of cash depositing and dispensing machine, such as applications at a point of sale, the space surrounding the cash depositing and dispensing machine is limited. By displacing the arrangement vertically, the machine may be accessed in a convenient way in spite of there being further equipment located adjacent to the machine. The vertical displacement further allows for integrating the cash depositing and dispensing machine as a part of a desk area, or table. In such a configuration, a lower portion of the machine body may be hidden inside the desk structure, while still allowing for dispensing and depositing, as well as accessing the interior parts of the machine (i.e. the arrangement), at an upper portion of the machine.

According to some embodiments, the arrangement is supported by one or more constant force springs such that the one or more constant force springs at least partly counteracts the weight of the arrangement. The use of constant force springs may provide support for the arrangement so as to allow a user to displace the arrangement between the closed position, the service position and the cash access position by hand without the user having to carry the entire weight of the arrangement. It is also conceivable that the displacing of the arrangement is achieved by means of one or more motors. In such a case, the use of constant force springs may decrease the load on the one or more motors as well as on any transmission parts coupling said one or more motors to the arrangement. The decreased load may reduce the wear.

It should also be realized that the arrangement may be associated with other elements, which may aid in displacement of the arrangement between the closed position, the service position and the cash access position. For instance, the arrangement may be associated with any type of spring, such as one or more gas springs.

According to some embodiments, the cash input/output unit comprises a lid which defines the outer surface of the cash input/output unit, said lid being pivotally coupled to the arrangement so as to allow access to inner parts of the cash input/output unit when the lid is in an open position. This may be advantageous as it allows for accessing at least parts of the input/output unit when the arrangement is in the closed position. Thus, banknote and/or coin jams as well as dust removal and cleaning of the input/output unit may be performed without having to open the main parts of the machine, i.e. to displace the arrangement away from the closed position.

Also, a cash input/output unit comprising a lid may be useful in relation to filling and/or emptying the cash storage unit by CIT personnel. The CIT personnel may use a portable carrier, which may provide a secure storage of banknotes. The portable carrier may further have an interface, which may be connected to the machine for forming a closed system by the machine and the portable carrier. Banknotes may then be transferred in a secure manner between the portable carrier and the cash storage unit for filling and/or emptying the cash storage unit. By opening the lid of the cash input/output unit, an interface may be provided which is suitable for connecting the portable carrier to the machine. For instance, the open position of the cash input/output unit may provide a form factor that fits the portable carrier, whereas the closed position of the cash input/output unit may provide a form factor that is adapted to ergonomy of a user for depositing banknotes into the machine or receiving banknotes from the machine. However, it should be realized that the cash input/output unit may be designed to allow the portable carrier to be connected to the machine without use of a lid in an open position.

According to some embodiments, the cash handling unit comprises a cash transport system configured to transport cash between the cash input/output unit and the cash storage unit. Service to the cash transport system may be performed while the arrangement is in the service position. The concept of displacing the whole arrangement protruding out of the machine body may allow providing accessing to the cash transport system from many directions. Thus, service access may be improved.

According to some embodiments, the cash handling unit further comprises a cash validation unit configured to validate cash for detecting one or more from: legitimate cash, counterfeit cash, and damaged cash. The cash validation unit may also be serviced while the arrangement is in the service position.

According to some embodiments, the cash validation unit is configured to determine whether cash is to be rejected or accepted and the cash handling unit is configured to redirect rejected cash to be output to a user through the cash input/output unit.

According to some embodiments, the cash storage unit comprises one or more containers configured to store cash supplied thereto from the cash handling unit. In preferred embodiments, a plurality of containers is used. The plurality of containers may be configured to store different kind of cash. For example, the containers may be configured to store different denominations of cash.

As access to the cash storage unit may be provided from many angles, the one or more containers may be easier to access for removal and/or replacement. Specifically, according to some embodiments, the one or more containers may be accessed from opposite sides of the machine. Thus, a first subset of containers may be accessed from a first side, and a second subset of containers may be accessed from a second side. The cash access position thus solves a problem of accessing individual containers from many sides of the machine using one single means for access, namely the displacement to the cash access position. Also, it allows for designing the machine for more efficient use of the interior volume of the machine without jeopardizing the demands for access.

It is understood that the cash input/output unit, the cash handling unit and the cash storage unit are configured to operate as one system and that cash may be transported between the units in many different ways within the scope of the claims.

The cash input/output unit is configured to receive cash input by a user and transport the cash to the cash handling unit. Furthermore, the cash input/output unit is configured to receive cash from the cash handling unit and dispense the cash to the user. Thus, the cash handling unit is configured to receive cash from the cash input/output unit. The interface between the cash handling unit and the cash input unit may be an opening in an internal wall of the machine disposed between the cash handling unit and cash input/output unit.

The cash handling unit is further configured to output cash to the cash storage unit. The interface between the cash handling unit and the cash storage unit may be an opening in a further internal wall disposed between the cash handling unit and cash storage unit. The cash storage unit is configured to receive cash from the cash handling unit and store cash in at least one container of the cash storage unit. This implies that the cash storage unit comprises transport means of its own.

According to some embodiments, the cash storage unit comprises a cash delivery and withdrawal system configured to deliver and withdraw cash from the one or more containers. The cash delivery and withdrawal system may be further configured to transport cash between the one or more containers and the cash handling unit. This implies that the cash delivery and withdrawal system of the cash storage unit may receive cash from the cash transport system of the cash handling unit at an interface between them. Similarly, the cash delivery and withdrawal system of the cash storage unit may deliver cash to the cash transport system of the cash handling unit at the interface between them.

According to some embodiments, the cash depositing and dispensing machine is a bank note depositing and dispensing machine. This implies that the cash input/output unit, the cash handling unit and the cash storage unit are specifically adapted to handle banknotes, i.e. paper. Thus, the cash transport system of the cash handling unit and/or the cash delivery and withdrawal system of the cash storage unit may each comprise a system of conveyor belts configured to transport banknotes, one by one, between different parts of the machine. For example, such a system of conveyor belts may be configured to supply pressure to the banknotes on both sides thereof. This implies that two separate conveyor belts may be in contact with a banknote at each position along a banknote transport path.

It is understood that the cash depositing and dispensing machine of the disclosure is not limited to any specific type of cash. Thus, the cash depositing and dispensing machine may be a coin depositing and dispensing machine configured to handle coins. It is also conceivable that the cash depositing and dispensing machine is configured to handle both banknotes and coins.

According to a second aspect there is provided a method for accessing a cash depositing and dispensing machine according the first aspect, wherein the arrangement is initially in the closed position, the method comprising:

receiving an access authorization to the machine, in case the access authorization pertains to allowing access to both the cash handling unit and to the cash storage unit:

displacing the arrangement from the closed position, via the service position, to the cash access position, and in case the access authorization pertains to allowing access to the cash handling unit and preventing access to the cash storage unit:

displacing the arrangement from the closed position to the service position.

The method may be advantageous as it allows for controlling access to the machine dependent on the authorization of the person that are about to access it. Thus, a service technician may obtain an access authorization by means of which he/she will be able to displace the arrangement to the service position so as to access the cash handling unit. Thus, the service technician may service e.g. the cash transport unit and the cash validation unit, but is prevented from accessing the cash storage unit. Similarly, cash in transit personnel may obtain another access authorization by means of which they will be able to displace the arrangement to the cash access position so as to access both the cash handling unit and the cash storage unit. Thus, the cash in transit personnel may remove, or supply, cash to the cash storage unit.

According to some embodiments, the access authorization is obtained by one or more from the steps of:

the user inserting a key into a mechanical lock of the machine, the user inputting a code to the machine, the machine recognizing a biometric characteristic of a user, the machine recognizing a characteristic signal from an external device, such as a radio frequency identifier (RFID) tag, and an authorization signal from a controlling software of an external unit wirelessly connected to the machine.

Effects and features of the second aspect are largely analogous to those described above in connection with the first aspect. Embodiments mentioned in relation to the first aspect are largely compatible with the second aspect. It is further noted that the inventive concepts relate to all possible combinations of features unless explicitly stated otherwise.

BRIEF DESCRIPTION OF THE DRAWINGS

The above, as well as additional objects, features and advantages of the present inventive concept, will be better understood through the following illustrative and non-limiting description, with reference to the appended drawings. In the drawings like reference numerals will be used for like elements unless stated otherwise.

In FIG. 1A, an arrangement is in a closed position, in FIG. 1B, the arrangement is in a service position, and in FIG. 1C, the arrangement is in a cash access position.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

A cash depositing and dispensing machine 100 according to an example embodiment will now be described with reference to FIGS. 1A-D and FIGS. 2-4. The cash depositing and dispensing machine 100 of the example is configured for handling banknotes. The cash depositing and dispensing machine 100 comprises a machine body 105 having outer circumferential walls 106, and an arrangement 110 being displaceable in relation to said machine body 105 along a displacement direction L (see FIG. 1C). The displacement direction L is aligned substantially vertically, so as to allow the arrangement 110 to be accessible in a volume above the machine 100. The arrangement is displaceable between a closed position P1 (see FIG. 1A), a service position P2 (see FIG. 1B) and a cash access position P3 (FIG. 1C). The three positions will be further described later.

Figure 1A:
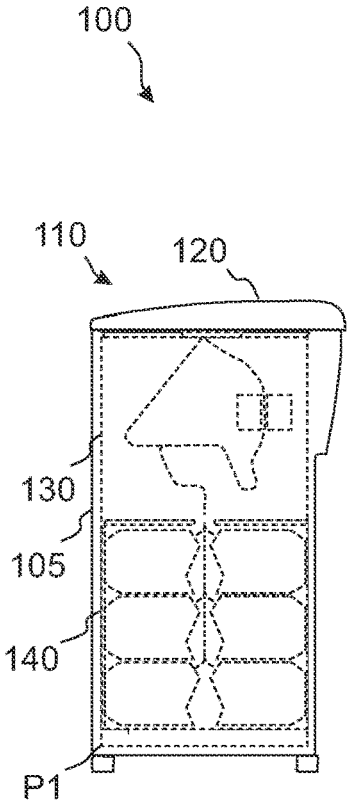
FIG. 1A-C shows side views of a cash depositing and dispensing machine according to an embodiment of the present disclosure.
Figure 1B:
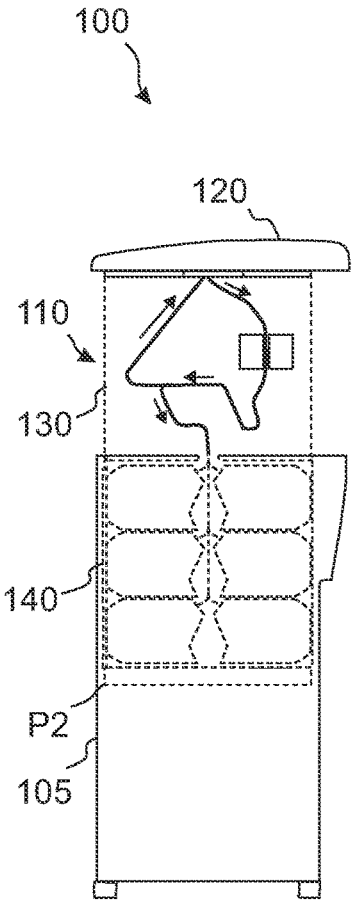
Figure 1C:
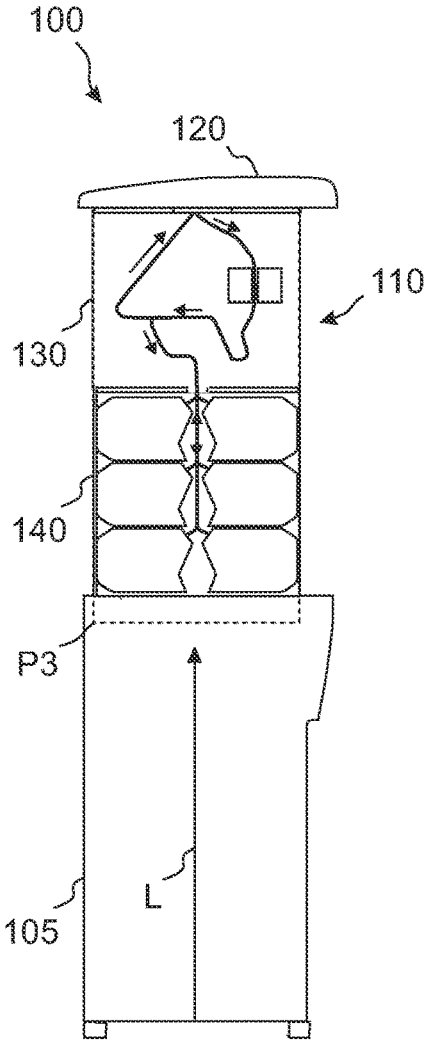
Figure 1D:
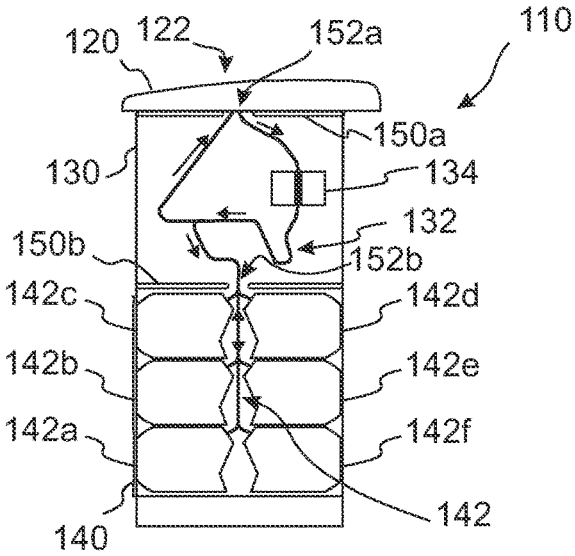
FIG. 1D shows a side view of the arrangement of the cash depositing and dispensing machine of FIGS. 1A-C.
Figure 2:
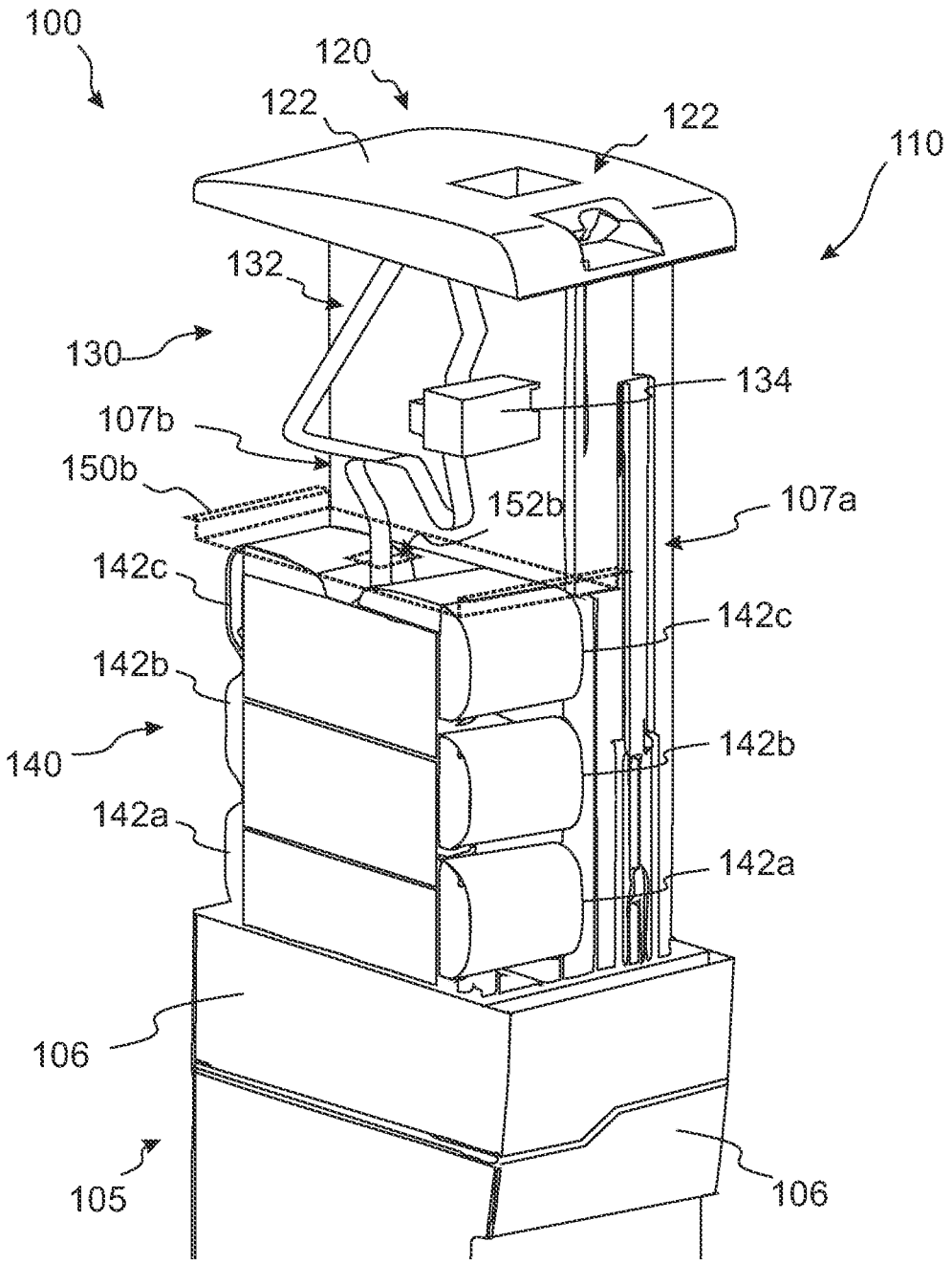
FIG. 2 shows a perspective top view of the cash depositing and dispensing machine of FIG. 1A-C when the arrangement is in the cash access position.

The arrangement 110 is illustrated from the side in an isolated view in FIG. 1D. The arrangement 110 comprises a cash input/output unit 120 having an interface 122 for allowing depositing and dispensing of cash. The interface 122 comprises one opening for receiving banknotes from a user and another opening for dispensing banknotes to the user. As can be seen in FIG. 1D, the cash input/output unit 120 defines an upper portion of the arrangement 110. When the arrangement 110 is in the closed position P1, the outer circumferential walls 106 of the machine body 105 meet an outer surface 122 of the cash input/output unit 120 such that said outer circumferential walls 106 and said outer surface 122 of the cash input/output unit 120 together define an outer seal for preventing access to the arrangement 110 as well as other interior parts of the machine 100. Thus, the cash input/output unit 120 effectively defines a portion of an exterior of the machine 100. In the example, the cash input/output unit 120 defines a top portion of the machine exterior.

Figure 3:
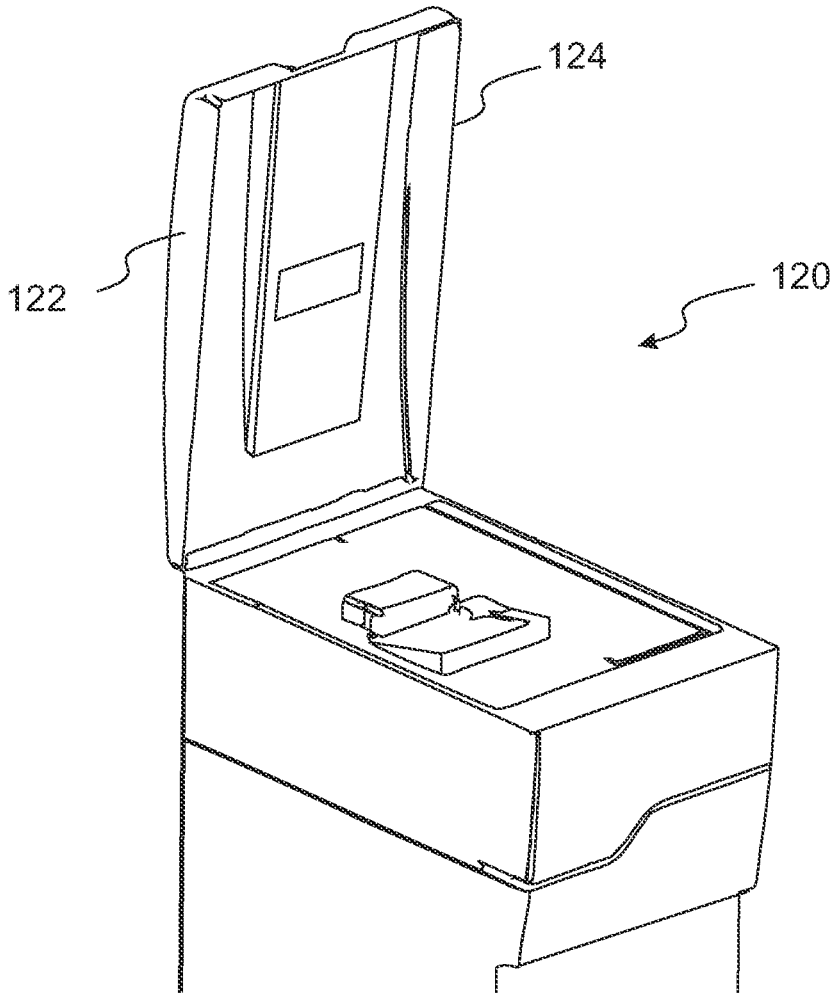
FIG. 3 shows a perspective top view of an upper portion of the cash depositing and dispensing machine of FIG. 1A-C when a lid of a cash input/output unit is in an open position.

As can be seen in FIG. 3, the cash input/output unit 120 comprises a lid 124 which defines the outer surface 122 of the cash input/output unit 120. The lid 124 is pivotally coupled to the arrangement 110 so as to allow access to inner parts of the cash input/output unit 120 when the lid 124 is in an open position. This allows for servicing and cleaning the interface 122, as well as clearing any paper jam at the cash input/output unit 120.

The cash/input output unit 120 may comprise an alignment mechanism for straightening banknotes and aligning banknotes to a reference edge, before the banknotes are transferred further into the machine 100. Jams in handling of banknotes are most common in a transfer from the alignment mechanism further into the machine 100. Thus, by having a lid 124, which is openable, a large percentage of jams occurring in the machine 100 may be handled by simply opening the lid 124.

Further, in an open position of the lid 124, the cash input/output unit 120 may present an interface which is suitable for connecting a portable carrier to the machine 100. The portable carrier may provide a secure storage of banknotes. By a secure connection of the portable carrier to the cash input/output unit 120 in the open position of the lid 124, banknotes may then be transferred in a secure manner between the portable carrier and a cash storage unit 140 for filling and/or emptying the machine 100.

The arrangement 110 further comprises a cash handling unit 130. In the example, the cash handling unit is disposed just below the cash input/output unit 120. The cash handling unit 130 is configured to receive cash from the cash input/output unit 120. Furthermore, the cash handling unit 130 is configured to deliver cash to the cash input/output unit 120 to be dispensed to a user. For the purpose, the cash handling unit 130 comprises a cash transport system 132 configured to transport cash within, and out from, the cash handling unit 130. The cash transport system 132 is schematically illustrated in FIGS. 1A-D and FIG. 2. There are many alternative ways known in the art how to provide transport of cash within cash depositing and dispensing machines. For example, the cash transport system 132 may comprise a system of conveyor belts configured to transport banknotes, one by one, between different parts of the machine 100. The system of conveyor belts is configured to supply pressure to the banknotes on both sides thereof. Thus, two separate conveyor belts may be in contact with a banknote at each position along a banknote transport path.

The cash handling unit 130 further comprises a cash validation unit 134 configured to validate cash for detecting one or more from: legitimate cash, counterfeit cash, and damaged cash. Specifically, a banknote deposited into the input/output unit 120 of the machine 100 will be transported to the cash validation unit 134 to be validated before any decision is taken on how to handle the banknote. In other words, the cash validation unit 134 is configured to determine whether cash is to be rejected or accepted. The cash handling unit 130 is configured to redirect rejected cash to be output to a user through the cash input/output unit 120.

The arrangement 110 further comprises a first internal wall 150*a* and a second internal wall 150*b*. The first internal wall 150*a* is disposed between the cash input/output unit 120 and the cash handling unit 130. The first internal wall 150*a* comprises an opening 152*a* for allowing cash to be transported between the cash input/output unit 120 and the cash handling unit 130. The second internal wall 150*b* is disposed between the cash handling unit 130 and the cash storage unit 140. The second internal wall 150*b* comprises an opening 152*b* for allowing cash to be transported between the cash handling unit 130 and the cash storage unit 140. The first internal wall 150*a* and the second internal wall 150*b* allows for limiting access between the different units of the arrangement 110.

The arrangement 110 further comprises a cash storage unit 140. In the example, the cash storage unit 140 is disposed just below the cash handling unit 130 separated therefrom by the second internal wall 150*b*. The cash storage unit 140 comprises one or more containers 142*a-f* configured to store cash supplied thereto from the cash handling unit 130. The cash storage unit 140 is configured to receive cash from the cash handling unit 130 and store cash in one or more containers 142*a-f* of the cash storage unit 140. The cash storage unit 140 is further configured to fetch cash from the at least one container 142*a-f* of the cash storage unit 140 and provide said cash to the cash handling unit 130 to be further transported and dispensed to the user. The cash storage unit 140 comprises a cash delivery and withdrawal system 142 configured to deliver and withdraw cash from the one or more containers 142*a-f*. The cash delivery and withdrawal system 142 is further configured to transport said cash to the cash handling unit 130.

The one or more containers 142*a-f* constitutes a modular system, which allows for easy removal and/or replacement of individual containers 142*a-f*. The flexible modular system has several advantages. For example, it allows for easy removal of malfunctioning containers without affecting remaining containers 142*a-f*. The machine 100 may be configured to allow operation with any number of containers. For example, if a malfunctioning container is removed, and a replacement is not available, the machine 100 may be reconfigured to use the remaining containers only. The machine 100 may control which containers are to receive a specific denomination. The machine 100 may be configured to store different denominations in different containers. Alternatively, the machine 100 may be configured to store a mix of denominations in a specific container. When emptying the machine 100 from cash, individual containers may be removed while keeping the stored cash inside the individual containers also during transit. This increases safety and speeds up the process of cash removal. In case the one or more containers 142*a-f* are configured to store banknotes, the banknotes may be stored in a rolled-up configuration. Alternatively, the banknotes may be stored in a stacked configuration.

As illustrated in FIGS. 1A-D and FIG. 2, the cash input/output unit 120, the cash handling unit 130, and the cash storage unit 140 are arranged in relation to each other along the displacement direction L. Thus, they are aligned in a stacked order.

As previously mentioned, the arrangement 110 is displaceable in relation to said machine body 105 along the displacement direction L between different positions. This is best visualized in FIGS. 1A-C.

FIG. 1A illustrates a case in which the arrangement 110 is in a closed position P1. In the closed position P1, the outer circumferential walls 106 of the machine body 105 enclose the cash handling unit 130 and the cash storage unit 140 so as to prevent access thereto. The closed position P1 is the default position of the arrangement 110 during normal use of the machine 100, allowing deposition of cash into the machine 100 and dispensing of cash from the machine 100.

FIG. 1B illustrates a case in which the arrangement 110 is displaced to a service position P2. In the service position P2, the cash handling unit 130 but not the cash storage unit 140 protrudes from the machine body 105 so as to allow access to the cash handling unit 130 and prevent access to the cash storage unit 140. The service position P2 is typically used when servicing the machine 100.

FIG. 1C illustrates a case in which the arrangement 110 is displaced to a cash access position P3. In the cash access position P3, both the cash handling unit 130 and the cash storage unit 140 protrude from the machine body 105 so as to allow access to the cash handling unit 130 and the cash storage unit 140. The cash access position P3 is typically used when cash are to be emptied or supplied to the cash storage unit 140 of the machine 100 by e.g. cash in transit personnel. As access to the cash storage unit 140 may be provided from many angles, the one or more containers 142*a-f* may be easier to access for removal and/or replacement. Specifically, for the example embodiment, the one or more containers 142*a-f* may be accessed from opposite sides of the machine 100. Thus, a first subset 142*a-c* of containers is accessed from a first side of the machine 100, and a second subset 142*d-f* of containers is accessed from a second side of the machine 100. The cash access position P3 thus solves the problem of accessing individual containers using one single means for access, namely the displacement to the cash access position.

Figure 5:
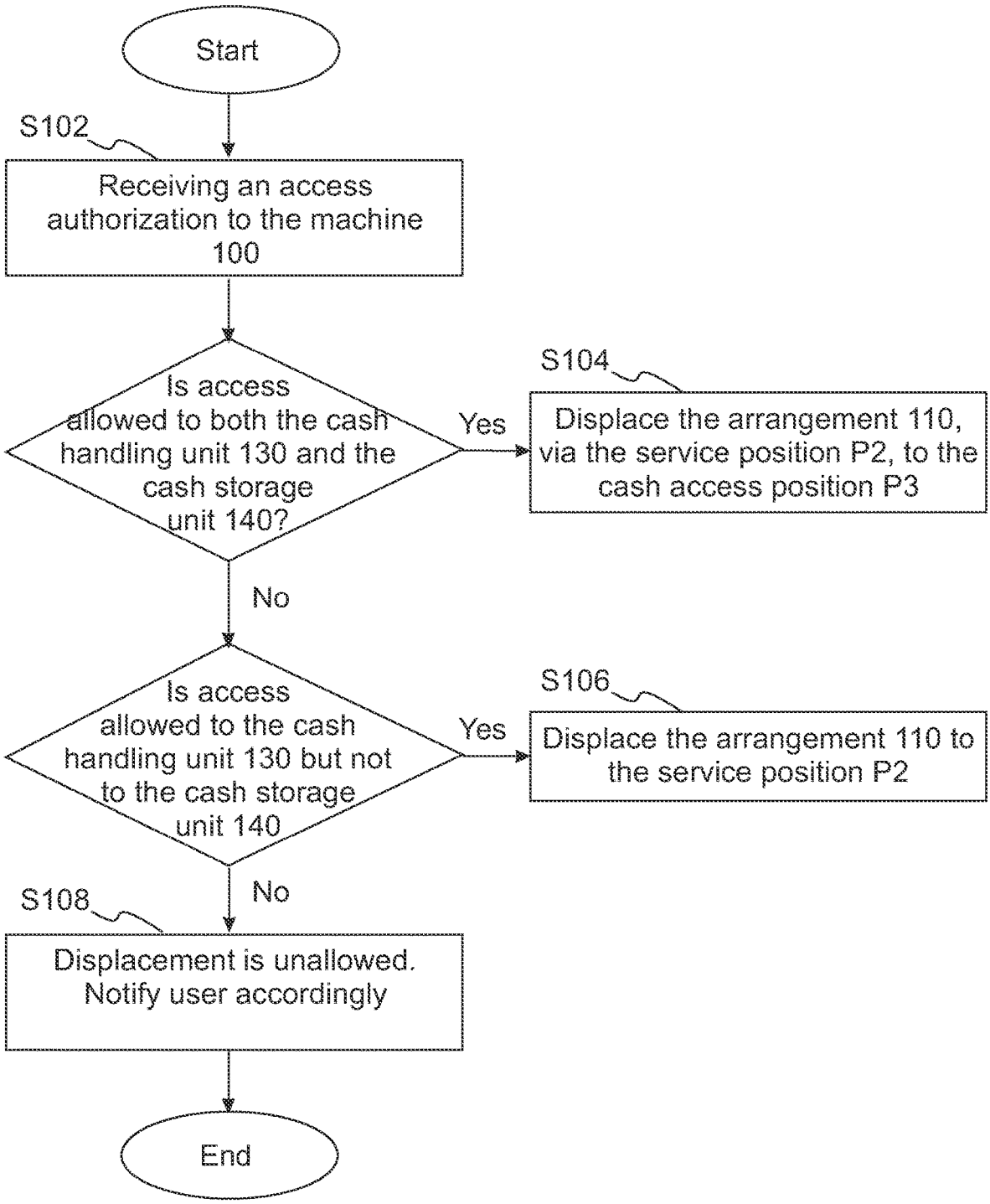
FIG. 5 shows a flow chart of a method for accessing a cash depositing and dispensing machine of the disclosure.

The three positions allow for different degree of access to the machine 100 while using the same mechanical solution. This may be further described by a method for accessing the cash depositing and dispensing machine 100 having an arrangement 110 in the closed position P1, as illustrated in FIG. 5. The method comprises receiving S102 an access authorization to the machine 100. In case the access authorization pertains to allowing access to both the cash handling unit 130 and to the cash storage unit 140, the arrangement 110 is displaced S104 from the closed position P1, via the service position P2, to the cash access position P3. Alternatively, in case the access authorization pertains to allowing access to the cash handling unit 130 and preventing access to the cash storage unit 140, the arrangement 110 is displaced S106 from the closed position P1 to the service position P2.

The access authorization may be obtained by the user inserting a key into a mechanical lock of the machine 100 or the user inputting a code to the machine 100. The machine 100 may be provided with keyhole(s) under the lid 124. Thus, the lid 124 may need to be opened in order to provide access to the keyhole for inserting a key and releasing a mechanical lock. The machine 100 may be provided with two keyholes, a first keyhole for releasing a first lock to allow access to the service position P2 and a second keyhole for further releasing a second lock to allow access to the cash access position P3.

Alternatively, the machine 100 may comprise a sensor for detecting a feature which may enable authorization. Thus, the sensor may comprise a sensor for detecting a biometric characteristic, such as a fingerprint of a user and, if the machine 100 recognizes the biometric characteristic as belonging to an authorized user, the access authorization may be obtained. As a further alternative, the machine 100 may comprise a sensor for detecting or receiving an identification that may be associated with a user. For instance, the machine 100 may comprise a receiver for receiving a signal from an RFID tag or the machine 100 may comprise a reader for reading a barcode, such as a two-dimensional barcode, e.g. a Quick Response (QR) code.

The machine 100 may also be connected to an external unit, e.g. via a wired or a wireless network. The external unit may be a server running a supervisor software, which may control a plurality of machines 100 that may be arranged in different locations. The supervisor software may provide information about the machine 100 and may store a log of events at the machine 100. The access authorization may be obtained as a message from the supervisor software providing authorization. The supervisor software may then store a log of identities of users that have accessed the machine 100. Also, the machine 100 may be set to only allow access via the supervisor software, such that an alarm is caused if the machine 100 is not opened via the authorization message from the supervisor software.

Any of the access authorizations associated with an input of information to the machine 100, via e.g. user-inputted code, RFID tag, or a message from the supervisor software, may be associated with the machine 100 actuating release of a lock, such as by actuating a solenoid or an electric motor for releasing a lock and allowing access to the machine 100.

The machine 100 may be provided with two or more sets of locks for controlling access to the service position P2 and the cash access position P3. Each of the set of locks may prevent displacement of the arrangement 110. The sets of locks may be mounted on an interior wall of the machine body 105 or any stationary part within the machine body 105. The locks may further be configured to, in a locked position, engage with the arrangement 110 for preventing displacement of the arrangement 110. The locks may for instance be mechanically moved to release an engagement with the arrangement 110 and allowing the arrangement 110 to be displaced. It should be realized that in an alternative, the locks may instead be mounted on the arrangement 110 and be arranged to engage with the interior wall of the machine body 105.

In the example embodiment, the arrangement 110 is linearly displaceable in relation to said machine body 105. This is achieved by means of a rail system 107*a*,107*b*. In other words, the arrangement 110 is displaceable in relation to said machine body 105 using said rail system 107*a*,107*b*. As most clearly shown in FIG. 2, the rail system 107*a*,107*b* is a telescopic rail system comprising two rail sections 107*a*,107*b*, disposed on opposed sides of the arrangement 110. Each of the two rail sections 107*a*,107*b* comprises three individual rail elements configured to be linearly attached to each other, so as to allow telescopic extension enough for the displacement of the arrangement 110 to encompass the displacement distance between the closed position P1 and the cash access position P3.

Figure 4:
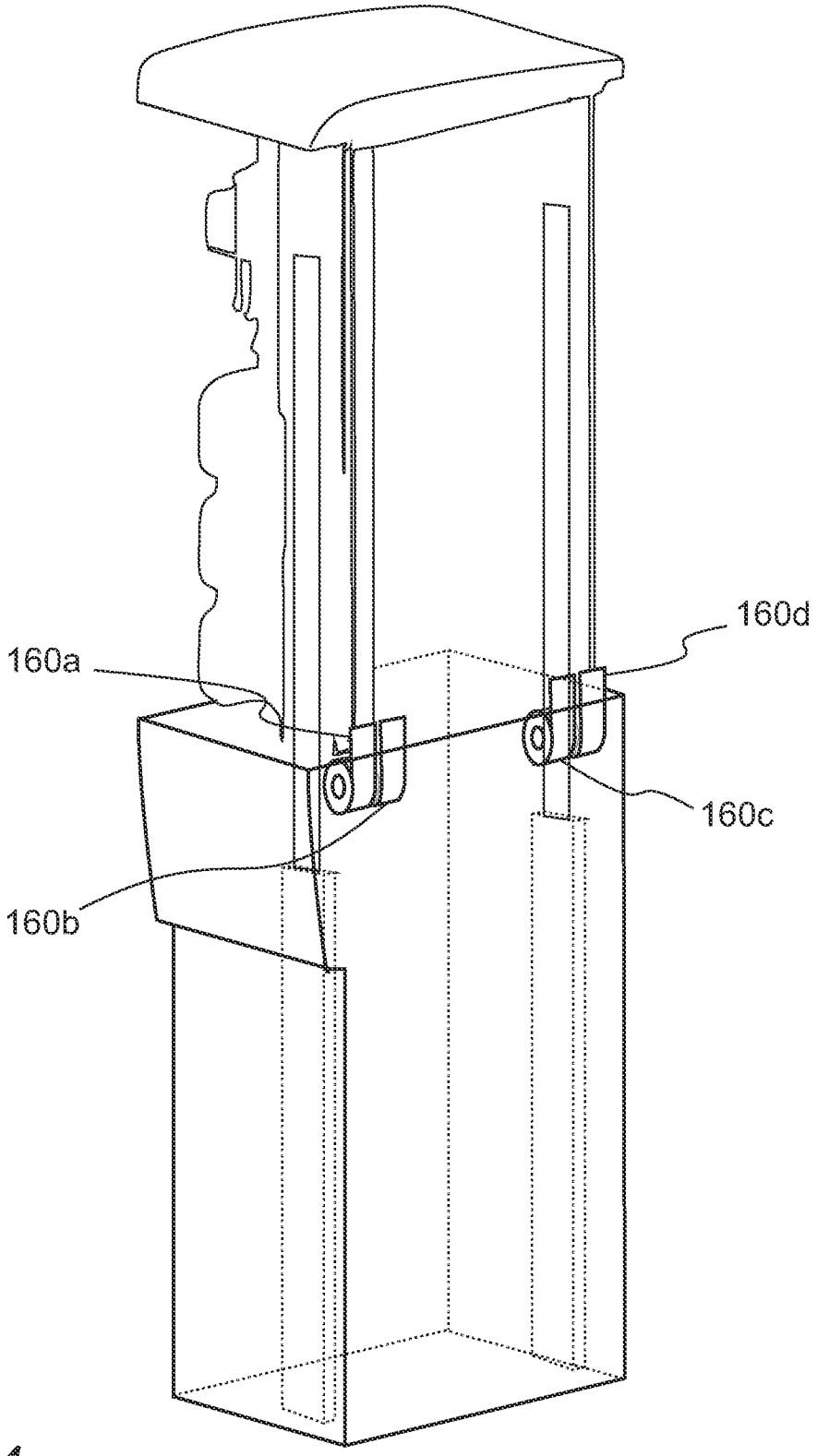
FIG. 4 shows a perspective side view of the cash depositing and dispensing machine of FIG. 1A-C when the arrangement is in the cash access position.

As illustrated in FIG. 4, the arrangement 110 is supported by four constant force springs 160*a-d*. The constant force springs 160*a-d* are configured to at least partly counteract the weight of the arrangement 110.

Each of the constant force springs 160*a-d* may comprise a rolled ribbon, e.g. of spring steel, such that the spring 160*a-d* is in a rolled up form when relaxed. A roll onto which the ribbon is rolled may be attached to a lower part of the arrangement 110. Further, the ribbon may be attached to an upper part of the interior wall of the machine body 105 or any other stationary part within the machine body 105.

When the machine 100 is in the closed position P1, the constant force springs 160*a-d* are unwinded and provide a lifting force to the arrangement 110. Thus, when the arrangement 110 is released, e.g. upon an access authorization, the constant force springs 160*a-d* will act on the arrangement 110 to move the arrangement 110 upwards. The force from the constant force springs 160*a-d* may e.g. be released by a spring-loaded sprint being pulled out from several holes along a vertical path of the arrangement 110. Thus, if the sprint is released, the arrangement 110 may stop by the sprint engaging a closest hole in a vertical direction, so as to prevent the arrangement 110 from achieving uncontrolled speed that might damage the machine 100. When releasing the sprint, there is friction on the sprint making it hard to pull the sprint out unless a user pushes the arrangement 110 down to balance the force from the constant force springs 160*a-d*. Thus, the constant force springs 160*a-d* may allow a lifting of the arrangement 110, while the displacement of the arrangement 110 may be controlled by a user to ensure that the arrangement 110 is subject to a smooth and controlled movement for assuming the desired position.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A cash depositing and dispensing machine comprising:
a machine body having outer circumferential walls, and
an arrangement comprising:
a cash input/output unit having an interface for allowing depositing and dispensing of cash,
a cash handling unit, and
a cash storage unit,
wherein the cash input/output unit is configured to receive cash input by a user and transport the cash to the cash handling unit, and to receive cash from the cash handling unit and dispense the cash to the user, and wherein the cash handling unit is further configured to output cash to the cash storage unit,
wherein said cash input/output unit, said cash handling unit, and said cash storage unit being arranged in relation to each other along a displacement direction, and
wherein the arrangement is displaceable in relation to said machine body along the displacement direction between:
a closed position for which the outer circumferential walls of the machine body enclose the cash handling unit and the cash storage unit so as to prevent access thereto,
a service position for which the cash handling unit but not the cash storage unit protrudes from the machine body so as to allow access to the cash handling unit and prevent access to the cash storage unit, and
a cash access position for which both the cash handling unit and the cash storage unit protrude from the machine body so as to allow access to the cash handling unit and the cash storage unit,
wherein, when the arrangement is in the closed position, the outer circumferential walls of the machine body meet an outer surface of the cash input/output unit such that said outer circumferential walls and said outer surface of the cash input/output unit together define an outer seal for preventing access to the cash handling unit and the cash storage unit.

2. The cash depositing and dispensing machine according to claim 1, wherein the arrangement is linearly displaceable in relation to said machine body.

3. The cash depositing and dispensing machine) according to claim 1, wherein the arrangement is displaceable in relation to said machine body using a rail system.

4. The cash depositing and dispensing machine according to claim 1, wherein the displacement direction is aligned substantially vertically, so as to allow the cash handling unit and the cash storage unit to be accessible in a volume above the machine.

5. The cash depositing and dispensing machine according to claim 4, wherein the arrangement is supported by one or more constant force springs such that the one or more constant force springs at least partly counteracts the weight of the arrangement.

6. The cash depositing and dispensing machine according to claim 1, wherein the cash input/output unit comprises a lid which defines the outer surface of the cash input/output unit, said lid being pivotally coupled to the arrangement so as to allow access to inner parts of the cash input/output unit when the lid is in an open position.

7. The cash depositing and dispensing machine according to claim 1, wherein the cash handling unit comprises a cash transport system configured to transport cash between the cash input/output unit and the cash storage unit.

8. The cash depositing and dispensing machine according to claim 7, wherein the cash handling unit further comprises a cash validation unit configured to validate cash for detecting one or more from: legitimate cash, counterfeit cash, and damaged cash.

9. The cash depositing and dispensing machine according to claim 8, wherein the cash validation unit is configured to determine whether cash is to be rejected or accepted and the cash handling unit is configured to redirect rejected cash to be output to a user through the cash input/output unit.

10. The cash depositing and dispensing machine according to claim 1, wherein the cash storage unit comprises one or more containers configured to store cash supplied thereto from the cash handling unit.

11. The cash depositing and dispensing machine according to claim 1, wherein the cash depositing and dispensing machine is a bank note depositing and dispensing machine.

12. A method for accessing a cash depositing and dispensing machine according to claim 1, wherein the arrangement is initially in the closed position, the method comprising:

receiving an access authorization to the machine, in case the access authorization pertains to allowing access to both the cash handling unit and to the cash storage unit:

displacing the arrangement from the closed position, via the service position, to the cash access position, and in case the access authorization pertains to allowing access to the cash handling unit and preventing access to the cash storage unit:

displacing the arrangement from the closed position to the service position.

13. The method according to claim 12, wherein the access authorization is obtained by one or more from the steps of:

the user inserting a key into a mechanical lock of the machine, the user inputting a code to the machine, the machine recognizing a biometric characteristic of a user, the machine recognizing a characteristic signal from an external device, such as a radio frequency identifier tag, and an authorization signal from a controlling software of an external unit wirelessly connected to the machine.

* * * * *